US011075043B2

(12) United States Patent
Lapiere

(10) Patent No.: US 11,075,043 B2
(45) Date of Patent: Jul. 27, 2021

(54) METHOD FOR CONTROLLING ELECTRICAL CURRENT SWITCHGEAR, ELECTROMAGNETIC ACTUATOR COMPRISING A CIRCUIT FOR IMPLEMENTING THIS METHOD AND ELECTRICAL SWITCHGEAR COMPRISING SUCH AN ACTUATOR

(71) Applicant: Schneider Electric Industries SAS, Rueil Malmaison (FR)

(72) Inventor: Christophe Lapiere, Grenoble (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 620 days.

(21) Appl. No.: 15/937,292

(22) Filed: Mar. 27, 2018

(65) Prior Publication Data

US 2018/0294120 A1 Oct. 11, 2018

(30) Foreign Application Priority Data

Apr. 11, 2017 (FR) ..... 17 53164

(51) Int. Cl.
*H01H 47/22* (2006.01)
*H01H 47/02* (2006.01)
(Continued)

(52) U.S. Cl.
CPC ..... *H01H 47/22* (2013.01); *H01H 47/02* (2013.01); *H01H 47/04* (2013.01); *H01H 50/18* (2013.01); *H01H 50/44* (2013.01)

(58) Field of Classification Search
CPC ..... H01H 47/22; H01H 47/04; H01H 47/02; H01H 50/44; H01H 50/18; H01H 47/002
(Continued)

(56) References Cited

U.S. PATENT DOCUMENTS 5,053,911 A * 10/1991 Kopec ..... H01H 47/04 361/154
5,784,245 A * 7/1998 Moraghan ..... H01H 47/002 361/154

(Continued)

FOREIGN PATENT DOCUMENTS

EP 0 400 389 A2 12/1990
EP 0 882 303 12/1998
EP 0 911 851 A1 4/1999

OTHER PUBLICATIONS

French Preliminary Search Report dated Dec. 11, 2017 in French Application 17 53164, filed on Apr. 11, 2017 (with English Translation of Categories of cited documents & Written Opinion).

*Primary Examiner* — Dharti H Patel
(74) *Attorney, Agent, or Firm* — Oblon, McClelland, Maier & Neustadt, L.L.P.

(57) ABSTRACT

A method for controlling switchgear includes the implementation of a limitation of the intensity value of the power supply current of a coil of an actuator, including acquisition of a power supply current limit value; generation of a reference value representative of the power supply current limit value; acquisition of a signal representative of the intensity of the power supply current circulating through the coil; comparison of the reference signal with the signal representative of the intensity of the power supply current; inhibition of the current power supply of the coil, as long as the intensity of the power supply current has a value greater than or equal to the reference value, the current power supply of the coil being re-established when the intensity of the power supply current returns below the reference value.

7 Claims, 4 Drawing Sheets

(51) Int. Cl.
*H01H 50/44* (2006.01)
*H01H 50/18* (2006.01)
*H01H 47/04* (2006.01)

(58) Field of Classification Search
USPC ..... 361/152
See application file for complete search history.

(56) References Cited

U.S. PATENT DOCUMENTS

| | | | | |
|---|---|---|---|---|
| 5,959,826 | A | 9/1999 | Baurand et al. | |
| 6,584,961 | B2 * | 7/2003 | Marceca | F02D 41/20 123/472 |
| 7,191,765 | B2 * | 3/2007 | Santero | F02D 41/20 123/490 |
| 2016/0133413 | A1 * | 5/2016 | Bock | H01H 50/026 361/142 |

* cited by examiner

METHOD FOR CONTROLLING ELECTRICAL CURRENT SWITCHGEAR, ELECTROMAGNETIC ACTUATOR COMPRISING A CIRCUIT FOR IMPLEMENTING THIS METHOD AND ELECTRICAL SWITCHGEAR COMPRISING SUCH AN ACTUATOR

The present invention relates to a method for controlling electrical current switchgear comprising an electromagnetic actuator. The invention relates also to an electromagnetic actuator comprising a control circuit for the implementation of this method and electrical switchgear comprising such an electromagnetic actuator.

The invention is more generally applicable to the technical field of electrical current switchgear, such as contactors.

As is known, such switchgear comprises a switching block, in which a mobile part can be displaced in relation to electrical connection terminals, between an open position and a closed position, to prevent or, respectively, allow the circulation of an electrical current between the connection terminals. Such switchgear also comprises a controllable electromagnetic actuator, which is adapted to selectively displace the mobile part between its open and closed positions. To this end, the actuator comprises a coil which is configured to generate a magnetic field which it is passed through by an electrical power supply current. Correspondingly, the mobile part is equipped with a magnetic element, such as a permanent magnet, which interacts with the magnetic field so as to create an electromagnetic force which displaces the mobile part.

Such switchgear also comprises a control circuit which drives the power supply of the coil, for example as a function of an external control signal. Typically, the switchover of the switchgear from the open position to the closed position is performed in two phases: an inrush phase, in which a first current is sent into the coil to displace the mobile part, then a holding phase, in which a second current is sent into the coil to hold the mobile part in the closed position. In effect, the actuator is nonlinear and the inductance of the coil exhibits different values between these two phases, because, in particular, of the mechanical load represented by the mobile part, or of variations of inductance as a function of the temperature of the coil.

The inrush current exhibits a high value, which is greater than the current value required in the holding phase. Sometimes, the inrush current is several times greater than the current value required in the holding phase.

Now, in many known electrical units, the actuator is without means for measuring the position of the mobile part, for the purpose of simplification. The inrush phase then has a predefined duration, regardless of the operating circumstances of the actuator. Thus, an inrush current of continuous high intensity has to be supplied to the coil even when the mobile part is finished its displacement, this inrush current being over dimensioned in relation to the current value which would be strictly necessary to hold the mobile part, this being done in order to maintain a safety margin to ensure that the switchgear can switch over to its closed position in all circumstances.

This known situation presents numerous drawbacks. In effect, the result thereof is that the energy consumption is higher than necessary, which presents a cost for the user, as well as an excessive heat dissipation. It is then necessary to provide heat sinks and/or cooling systems, which would increase the bulk and the cost of the unit. The manufacturing of the switchgear is thus made more complicated thereby.

It is these drawbacks that the invention sets out more particularly to remedy by proposing a method for controlling electrical current switchgear comprising a mobile switching part that can be displaced by means of an electromagnetic actuator provided with a coil, in which the power supply current consumption of the coil is reduced during a closure phase.

To this end, the invention relates to a method for controlling electrical current switchgear, this switchgear comprising an electromagnetic actuator provided with a coil for displacing a mobile switching part of the switchgear, this method comprising:

- the reception of a command to switchover the electrical switchgear from an open state to a closed state;
- in response, the supply of an electrical power supply current to a coil of the actuator, by means of a control circuit, to displace the mobile switching part from an open position to a closed position.

According to the invention, the supply of the power supply current comprises the implementation of a limitation of the intensity value of the electrical power supply current, this limitation comprising steps:

a) of acquisition of a power supply current limit value by a microcontroller of the control circuit, this value being stored in digital form in a memory of the control circuit;

b) of generation of a reference value in the form of an analogue signal, representative of the power supply current limit value, from the acquired limit value and by means of a digital-analogue converter of the control circuit;

c) of acquisition, by the control circuit, of a signal representative of the intensity of the power supply current circulating through the coil;

d) of comparison, by means of an analogue comparator of the control circuit, of the reference analogue signal with the signal representative of the intensity of the power supply current;

e) of inhibition, by the control circuit, of the current power supply of the coil, in response to the comparison, as long as the intensity of the power supply current has a value greater than or equal to the reference value, the current power supply of the coil being re-established when the intensity of the power supply current returns below the reference value.

By virtue of the invention, the limitation of the electrical power supply current of the coil during closure makes it possible to reduce the quantity of current consumed unnecessarily during the closure phase once the mobile part has reached its closed position. Furthermore, the use of an analogue comparator makes it possible to implement the comparison between the power supply current of the coil and the reference value independently of the microcontroller and therefore without consuming computation resources of the microcontroller. The operation of the control circuit is thus simplified.

According to advantageous but non-mandatory aspects of the invention, such a control method can incorporate one or more of the following features, taken alone or according to any technically admissible combination:

The generation of the reference signal comprises:

- the reading of the limit value stored in the memory, this reading comprising the emission of a request for direct access to the memory emitted by the converter by means of a memory controller of the control circuit, then,
- the transformation, by the converter, of the acquired limit value into an analogue signal forming the reference value.

The acquisition of the signal representative of the intensity of the power supply current is performed by means of a measurement probe belonging to the control circuit.

The current measurement probe comprises a measurement resistor connected in series with the coil and the acquisition comprises the measurement of the electrical voltage at the terminals of the measurement resistor.

The supply of the power supply current comprises the generation of an electrical power supply current by pulse width modulation by means of a controllable switch of the control circuit, this modulated electrical power supply current being supplied to the coil, this controllable switch being driven as a function of a control signal generated by a control module of the control circuit, and the inhibition of the current power supply comprising the holding of the control signal at a predefined value to interrupt the generation of the modulated power supply current.

According to another aspect, the invention relates to an electromagnetic actuator for electrical current electrical switchgear, comprising a coil and a control circuit adapted to electrically power the coil, the actuator being adapted to selectively displace a mobile switching part of the electrical switchgear under the action of the coil, the control circuit being adapted to:

receive a command to switchover the electrical switchgear from an open state to a closed state;

in response, supply an electrical power supply current to the coil to displace the mobile switching part from an open position to a closed position.

The control circuit is configured for the supply of the power supply current to include the implementation of a limitation of the intensity value of the electrical power supply current, this limitation comprising steps:

a) of acquisition of a power supply current limit value by a microcontroller of the control circuit, this value being stored in digital form in a memory of the control circuit;

b) of generation of a reference value in the form of an analogue signal, representative of the power supply current limit value, from the acquired limit value and by means of a digital-analogue converter of the control circuit;

c) of acquisition, by the control circuit, of a signal representative of the intensity of the power supply current circulating through the coil;

d) of comparison, by means of an analogue comparator of the control circuit, of the reference analogue signal with the signal representative of the intensity of the power supply current;

e) of inhibition, by the control circuit, of the current power supply of the coil, in response to the comparison, as long as the intensity of the power supply current has a value greater than or equal to the reference value, the current power supply of the coil being re-established when the intensity of the power supply current returns below the reference value.

According to another aspect, the invention relates to electrical current electrical switchgear, comprising a switching block and an electromagnetic actuator, the switching block comprising:

a fixed armature onto which connection terminals are fixed, and a mobile switching part, that can be displaced in relation to the connection terminals, between open and closed positions, to prevent or, respectively, allow the circulation of an electrical current between the connection terminals.

The electromagnetic actuator comprises a coil and a control circuit adapted to electrically power the coil, the electrical switchgear and the electromagnetic actuator being as described previously.

The invention would be better understood and other advantages thereof will become more clearly apparent in light of the following description, of an embodiment of a control method given purely by way of example and with reference to the attached drawings in which:

FIG. 1 represents a control circuit 2 for a controllable electromagnetic actuator of electrical current switchgear, such as a contactor.

Figure 1:
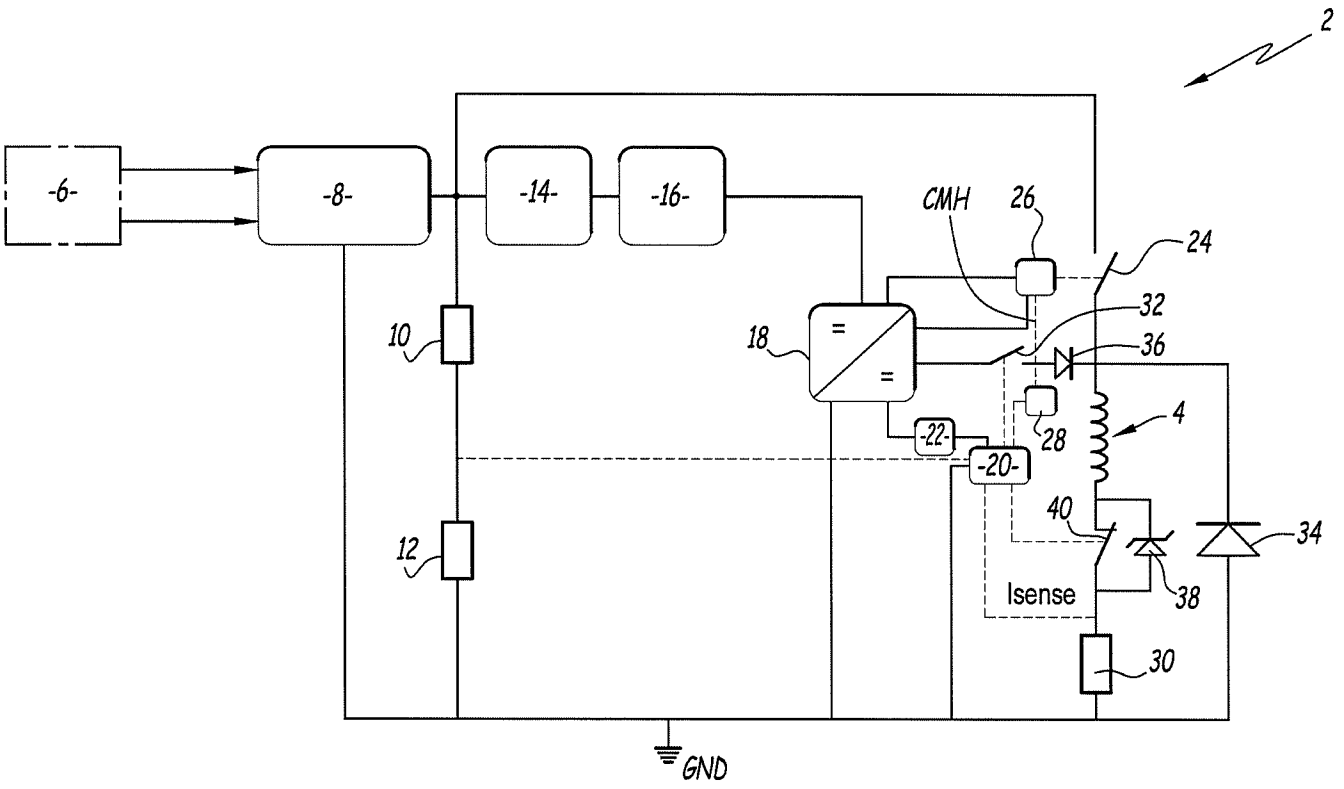
FIG. 1 is a schematic representation of a control circuit for an electromagnetic actuator of electrical current switchgear according to the invention.

This switchgear, not illustrated, comprises a switching block and an actuator block.

The switching block comprises a fixed armature onto which connection terminals are fixed, which are intended to be electrically connected to an electrical circuit, for example within an electrical distribution board. The switching block also comprises a mobile part, called mobile switching part, which can be displaced in relation to the connection terminals, between open and closed positions, to prevent or, respectively, allow the circulation of an electrical current between the connection terminals.

The actuator block contains the controllable electromagnetic actuator. The electromagnetic actuator is adapted to selectively displace the mobile part between its open and closed positions in response to a control signal, notably by virtue of the control circuit 2. The actuator here includes the control circuit 2.

The actuator comprises a coil 4, or solenoid, which is configured to generate a magnetic field when it is passed through by a modulated electrical power supply current delivered by the control circuit 2. For example, the coil 4 is formed by winding an electrically conductive wire around a support, this support extending here along a longitudinal axis.

Correspondingly, the mobile part is equipped with a magnetic element, such as a permanent magnet, which interacts with the magnetic field so as to displace the mobile part.

As an example, the mobile part can here be displaced in translation between its open and closed positions along an axis of displacement coaxial with the longitudinal axis of the coil. The mobile part is here, by default, in the open position, and is displaced to the closed position only under the action of the coil 4. An elastic return member is advantageously arranged to return the mobile part to its open position when the coil 4 is no longer powered.

The control circuit 2 is configured to supply an electrical power supply current to the terminals of the coil 4, in response to a control signal and according to a pre-established control method.

More specifically, in response to a command to switchover the switchgear to the closed position, the circuit 2 is configured to first of all implement a closure phase, also called inrush phase, by supplying sufficient energy to the coil 4 to displace the mobile part from the open position to the closed position, then a holding phase by supplying to the coil 4 sufficient energy to hold the mobile part in the closed position, notably by opposing the force exerted by the elastic return member.

The actuator here is without means for measuring the position of the mobile part, for the purpose of simplification.

In this example, the circuit 2 is connected to an external electrical power supply 6, which supplied one or more electrical power supply voltages to the circuit 2. Here, the power supply 6 delivers a voltage of 100 volts AC and a voltage of 250 volts AC on two distinct inputs of the circuit 2.

The circuit 2 also here comprises a power stage and a logic stage.

The power stage comprises equipment items for electrical protection and for transforming the received power supply voltage or, if necessary, received power supply voltages. The logic stage and the coil 4 are intended to be powered by the power stage.

In this example, the power stage of the circuit 2 comprises:

- a module 8 for protection and rectification of the received power supply voltages, powered by the source 6 and which delivers a direct electrical voltage at the output,
- input resistors 10 and 12, connected in series between the output of the module 8 and a common electrical ground GND of the circuit 2,
- a filter 14 protecting against electromagnetic interferences, connected to the output of the module 8, and
- a ballast 16, also called current limiter module, connected in series with the filter 14.

As a variant, these equipment items can be chosen differently.

In this example, the coil 4 is connected to the output of the module 8 via a controllable switch 24, to receive an electrical power supply current. In this example, as explained hereinbelow, this electrical power supply current is a modulated current created by pulse width modulation during a closure phase. This pulse width modulation technique, called PWM, is well known and is not described in more detail hereinbelow. For example, this modulated power supply current is a chopped signal.

The circuit 2 also comprises a power converter 18 of "flyback" type, the function of which is to supply a stabilized power supply to the internal components of the circuit 2. This converter 18 is powered by the direct voltage delivered by the module 8, here by being connected at the output of the ballast 16. In this example, the converter 18 belongs to the power stage.

The logic stage of the circuit 2 also comprises a programmable microcontroller 20 which is adapted in particular to drive the operation of the switch 24 to selectively control the power supply of the coil 4.

In this example, the microcontroller 20 is powered by the converter 18 via a linear regulator 22, of so-called low dropout regulator type, which delivers a direct voltage of 3.3 volts.

The circuit 2 also comprises a driving module 26, also called "driver", to actuate the displacement of the switch 24 as a function of a control signal CMH sent by the microcontroller 20. The module 26 is adapted to be powered electrically by the converter 18, here by a voltage of 15 volts and by a voltage of 8 volts. In this example, the microcontroller 20 is connected to the module 26 via an optocoupler 28, so as to ensure a galvanic isolation between the power stage and the logic stage.

Figure 2:
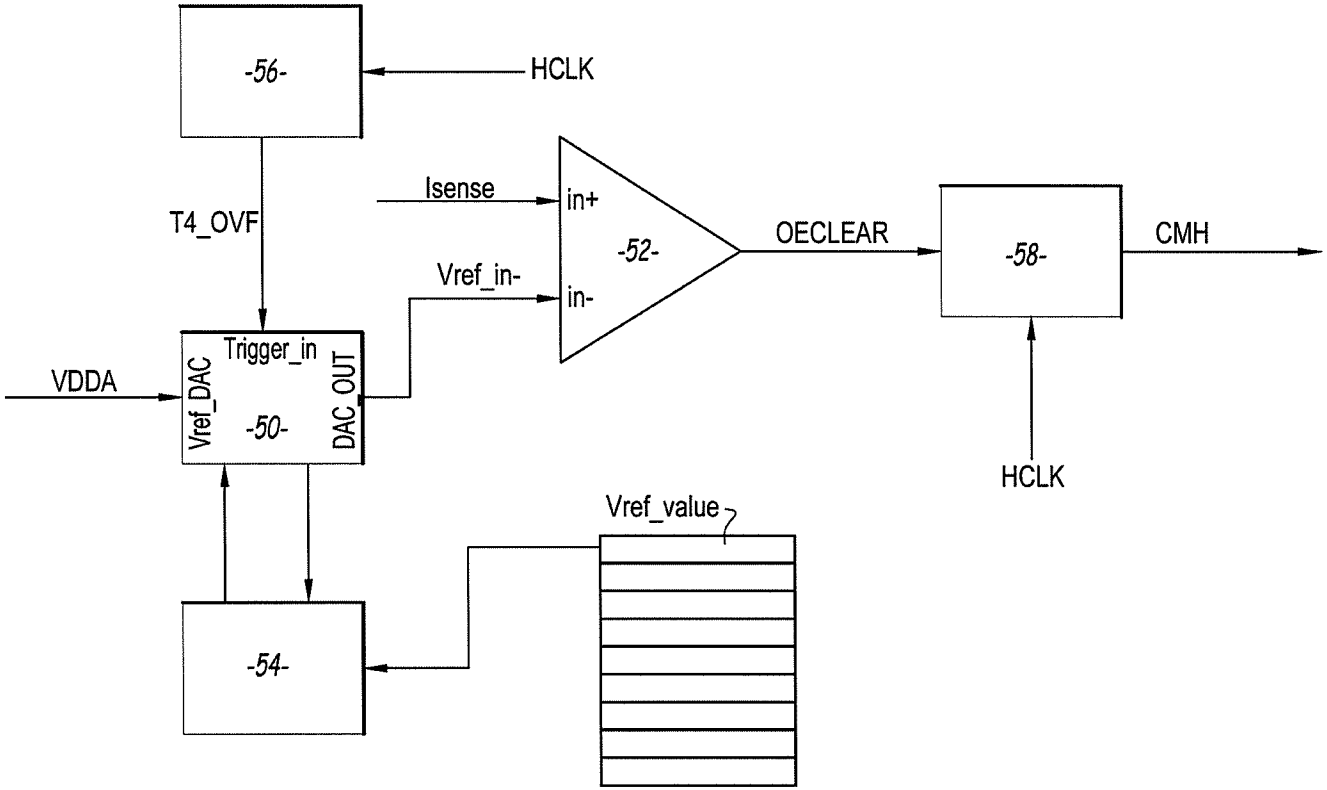
FIG. 2 is a simplified block diagram representation of the operation of an aspect of the control circuit of FIG. 1.

In FIG. 2, the dotted lines represent datalinks, suitable for transmitting data signals from and/or to the microcontroller 20.

The microcontroller 20 is also connected to an input voltage measurement probe, not illustrated, for example adapted to measure the electrical voltage within the circuit 2, for example between a mid-point situated between the input resistors 10 and 12 on the one hand and the electrical ground GND on the other hand.

The microcontroller 20 is also adapted to measure a quantity representative of the value of the electrical power supply current which circulates in the coil 4. For example, the circuit 2 comprises a current measurement probe to which the microcontroller 20 is connected on one of its inputs. This measurement probe here comprises a measurement resistor 30 connected in series with the coil 4, which makes it possible to measure an electrical voltage representative of the power supply current of the coil 4. This electrical voltage is here denoted "Isense" and forms a signal representative of the intensity of the power supply current circulating through the coil 4.

In this example, the circuit 2 also comprises a switch 32 that can be controlled by the microcontroller 20. This switch 32 is connected in series with a diode 36 and connects another output of the converter 18 to the coil 4.

A protection diode connected in parallel with the coil 4 is denoted "34". A normally-closed switch, connected here in series with the coil 4 and the measurement resistor 30, is denoted "40", this switch 40 being controllable by the microcontroller 20. The circuit 2 also comprises a zener diode 38 connected in parallel with this switch 40. The switch 32 makes it possible to drive the coil 4 during the holding phase. The switch 40 is intended to be activated during a subsequent opening phase. Together with the diode 38, this switch 40 makes it possible to demagnetize the coil 4.

FIG. 2 schematically represents the operation of the microcontroller 20.

The microcontroller 20 comprises an analogue-digital converter 50, an comparator 52, as well as a clock, not illustrated, adapted to generate a clock signal HCLK.

The circuit 2 also comprises a computer memory and a controller 54 of access to this memory. The memory is adapted to store at least one digital value, here coded on twelve bits.

For example, the digital value stored in the memory is a power supply current limit value acquired by the microcontroller 20 and denoted Vref_value.

This memory is, here, connected to the microcontroller 20 by means of a databus, not illustrated. The controller 54 is connected to the databus and is adapted to access the content of the memory, in particular to read it, by sending a request of direct memory access type. Thus, the controller 54 can access the content of the memory independently of the microcontroller 20. The reading of the value stored in the memory does not entail consuming computing resources of the microcontroller 20.

The converter 50 is adapted to transform a digital signal received on an input, not illustrated, into an analogue signal, delivered on an output DAC_OUT. More specifically, the function of the converter 50 is to convert the value Vref_value, represented by a digital signal, into a value Vref_in–, represented by an analogue signal, such as an electrical voltage. The converter 50 is, here, powered electrically by a reference voltage VDDA received on a power supply input Vref_DAC.

The emission of the memory access request is for example performed when a synchronization signal T4_OVF is received on a synchronization input Trigger_in.

The comparator 52 comprises a first input in+ and a second input in− and is configured to deliver an output signal OECLEAR, for example in the form of an electrical voltage which can take one or other of two distinct values, as a function of the values of these signals received on the inputs in+ and in−. The comparator 52 is configured in particular for the output signal OECLEAR to take:

- a low value as long as the value of the incoming signal on the input in+ is less than the value of the signal incoming on the input in−, and
- a high value when the value of the signal incoming on the input in+ is greater than or equal to the value of the signal incoming on the input in−.

The microcontroller 20 also comprises a synchronization module 56 and a PWM control module 58.

The module 56 is adapted to supply to the converter 50 the signal T4_OVF synchronized in relation to the clock signal HCLK.

The function of the module 58 is to create the pulse width modulation control signal CMH to control the opening and the closure of the switch 24. This control signal CMH is for example supplied to the driving module 26. This creation of the control signal CMH is performed by the module 58 as a function of the clock signal CLK and as a function of the signal OECLEAR generated by the comparator 52. The module 58 is programmed in particular for:

- as long as the signal OECLEAR is equal to the low value, the module 58 to generate a signal CMH according to a predefined set point, for example according to a pulsed periodic signal; and
- when the signal OECLEAR takes the high value, to interrupt the control signal CMH, so as to temporarily stop the power supply of the coil. That makes it possible to limit the value of the intensity of the current below the threshold value.

An example of operation of the circuit 2 is now described with reference to the flow diagram of FIG. 3 and using FIGS. 1 and 2.

Initially, the mobile part is in the open position. The switchgear is therefore in an electrically open state, to prevent the circulation of an electrical current between the connection terminals.

Then, the switchgear receives a command to switchover to the closed state. This command is transmitted by means of a predefined signal, for example by powering the circuit 2 from the power supply 6.

In response, the circuit 2 orders the displacement of the mobile part from its open position to the closed position, by supplying an electrical power supply current of the coil 4 for a predetermined duration, corresponding to the closure phase.

During this closure phase, the microcontroller 20 controls the successive opening and closure of the switch 24, here via the module 26, by supplying the control signal CMH generated by the module 58. That makes it possible to supply the coil 4 with a power supply current according to the pulse width modulation technique. Thus, from the direct current delivered by the power stage of the circuit 2 and in particular, here, by the converter 18, the coil 4 receives the modulated power supply current which allows the generation of the magnetic field and therefore of a magnetic force which displaced the mobile part.

The closure phase is here divided into two distinct subphases: a first subphase P1 and a second subphase P2, the respective duration of which depends on the displacement of the mobile part in response to the power supply current of the coil 4.

During the first subphase P1, the mobile part is displaced to the closed position from the open position. The subphase P1 ends when the mobile part reaches the closed position.

During the second subphase P2, which begins immediately after, the coil 4 continues to be powered according to the same pulse width modulation technique. However, since the mobile part is then immobiled in the closed position, the power supply current is greater than the minimum current strictly necessary to hold the mobile part in the closed position. The difference between the current thus supplied and the necessary minimum current corresponds to a "safety margin". In practice, the time needed to displace the mobile part can vary as a function of circumstances and is not known in advance. In particular, the operation of the electromagnetic actuator is nonlinear, particularly because of the variations of the inductance of the coil 4 as a function of the temperature.

The circuit 2 previously described makes it possible to implement, in this step, a method for regulating, or limiting, the value of the power supply current of the coil 4, to optimize the safety margin and reduce the current overconsumption of the coil 4 during the second subphase P2, without in any way degrading the safety of operation of the electrical switchgear.

To this end, in a step 100, the microcontroller 20 acquires a power supply current limit value, for example by reading this limit value, here from an external data storage medium and by means of a data exchange interface. This acquired value is then stored in the memory in the form of a digital signal Vref_value. In this example, the limit value is predetermined, preferably by being calculated in advance as a function of characteristics of the coil 4 and of the actuator and the rating of the contactor.

In a step 102, the digital-analogue converter 50 generates the reference value Vref_in− in the form of an analogue signal from the acquired limit value Vref_value. This reference value Vref_in− is representative of the power supply current limit value.

In this example, in this step 102, the converter 50 automatically acquired the limit value Vref_value stored in the memory, by emitting a direct memory access request by means of the memory controller 54. The controller 54 thus accesses the memory via the databus without invoking the microcontroller 20. This request is for example emitted each time the synchronization signal T4_OVF takes a particular value.

The digital value Vref_value is thus transmitted by the controller 54 to an input of the converter 50, which automatically converts this value Vref_value into an analogue signal forming the reference value Vref_in−.

In a step 104, the microcontroller 20 acquires the intensity value Isense of the power supply current, here by measuring the voltage at the terminals of the measurement resistor 30.

Next, in a step 106, the comparator 52 compares the values Vref_in− and Isense. Since this comparison is performed directly by the analogue comparator 52, it does not consume computation resources specific to the microcontroller 20. If the value Isense is determined in this comparison as being greater than or equal to the value Vref_in−, then, in a step 108, the circuit 2 orders the inhibition of the current power supply of the coil 4.

For example, the output signal OECLEAR of the comparator 52 switches from the low value to the high value. In response, the module 58 modifies the control signal CMH to modify the modulation ratio of the pulses, for example by keeping the control signal CMH at a predetermined value, for example a zero constant value. The switchover of the switch 24 is then modified accordingly, and the value of the intensity of the power supply current decreases. The intensity of the power supply current of the coil 4 is then limited and remains less than the limit value.

On the other hand, if the value Isense is determined in this comparison as being less than the value Vref_in−, then the power supply of the coil is not inhibited and is maintained. For example, the output signal OECLEAR remains at the low value and the module 58 generates the control signal CMH in a predefined manner as a function of the clock signal HCLK.

Thus, when the intensity Isense returns below the reference value Vref_in−, then the current power supply of the coil 4 is re-established. For example, the signal OECLEAR again takes the low value and the module 58 once again emits the signal CMH according to the predefined form.

Here, this method is executed repeatedly throughout the duration of the closure phase. In particular, the steps 102, 104 and 106 are, here, repeated in a loop throughout the duration of the closure phase. In particular, the comparison step 106 is, here, performed continuously, in particular by virtue of the analogue processing chain formed by the converter 50 and the comparator 52. The response time depends in particular on the time of propagation and of processing of the data by this analogue processing chain.

For example, at the end of the step 108, the method returns to the step 106.

In this example, the closure phase ends at the end of a predefined delay, counted down by the microcontroller 20.

At the end of the closure phase, the role of the actuator is to hold the mobile part in the closed position as long as it does not receive any contrary command. Thus, in a holding phase, the control circuit injects an electrical power supply current of the coil 4 which is different from the electrical power supply current injected during the closure phase. During this holding phase, the electrical power consumed by the coil 4 is thus less than the power consumed by the coil during the closure phase.

Finally, the switchgear can then be controlled to return to an electrically open state, to interrupt the circulation of the electrical current between the connection terminals. To do this, in an opening phase, the control circuit 2 stops supplying the coil 4 with current. The magnetic field is interrupted, as is the magnetic force. The mobile switching part therefore returns to the open position, for example under the action of the elastic return member.

Figure 4:
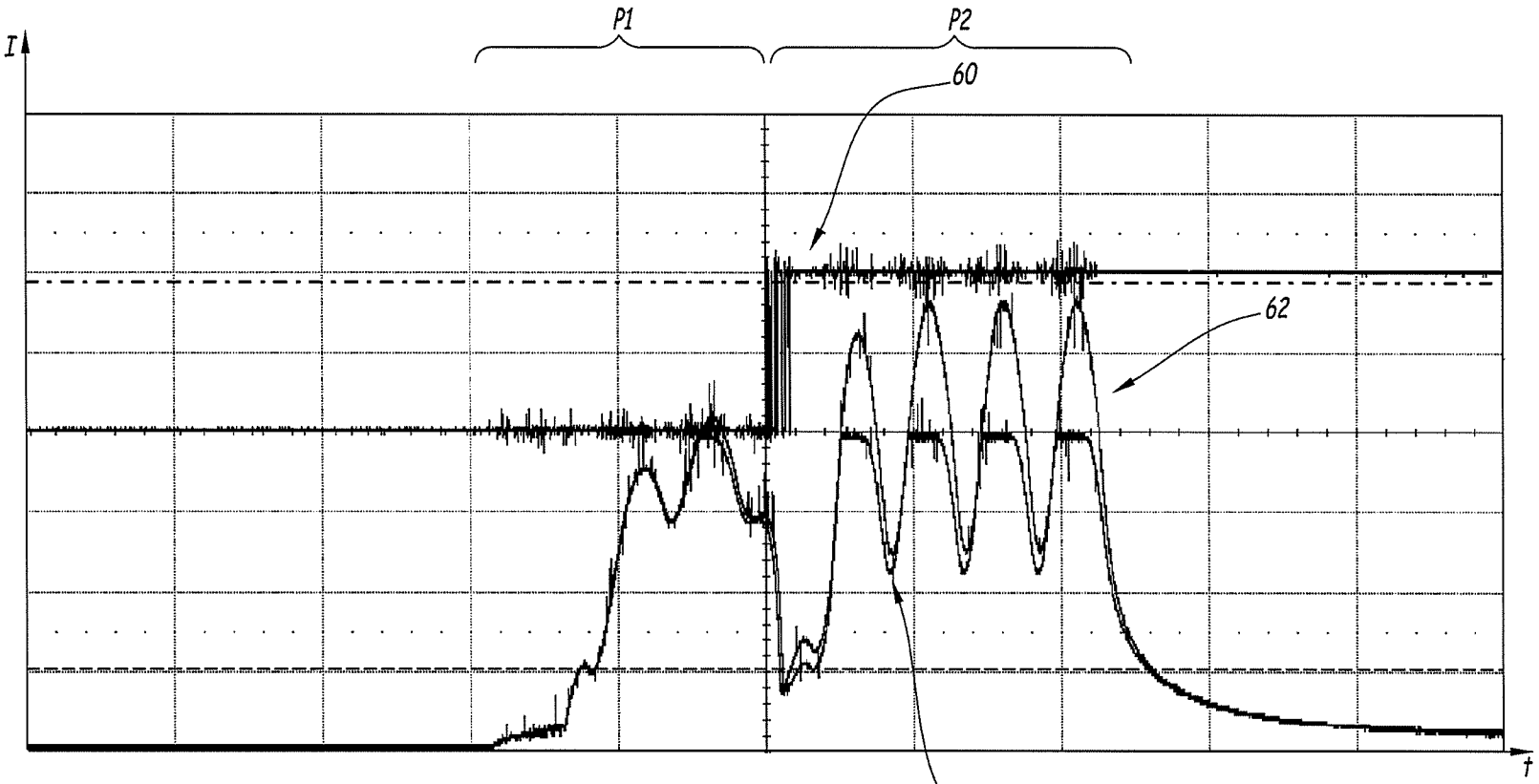
FIG. 4 is an oscillogram which schematically represents an example of comparison between the electrical power supply current values supplied to a coil of an electromagnetic actuator.

FIG. 4 represents examples of changing values I of power supply currents of the coil 4, on the y axis, as a function of the time t, on the x axis, in a closure phase during which the mobile part switches over to the closed position.

Figure 3:
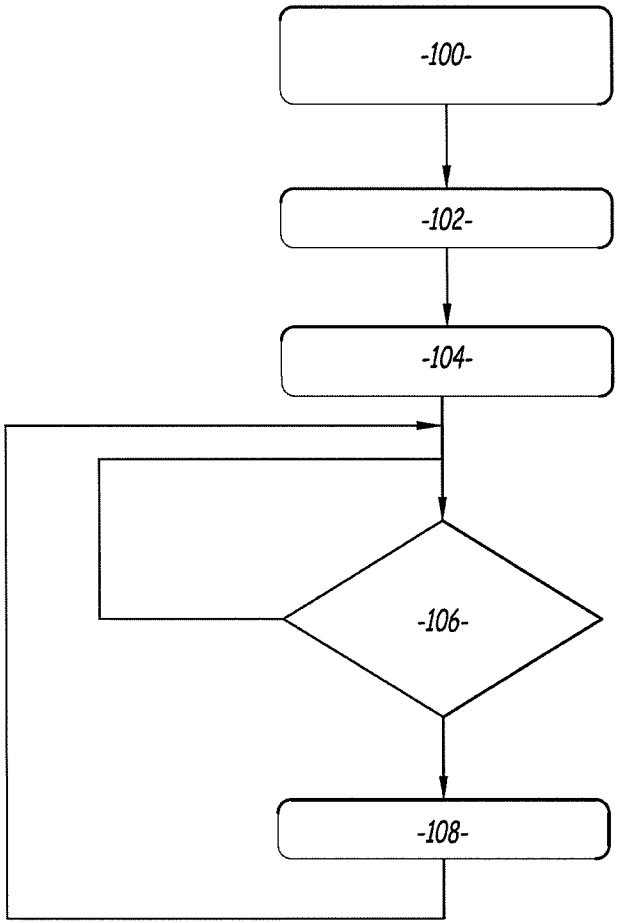
FIG. 3 is a flow diagram of an operating method of the control circuit of FIG. 1 according to the invention.

More specifically, the curve 62 represents the trend of the power supply current in a known case where the limiting method of FIG. 3 is not implemented, whereas the curve 64 represents an example of the trend of the power supply current in the case where the limiting method of FIG. 3 is implemented.

To the sides of these curves 62 and 64, the curve 60 represents the position of the mobile part of the switchgear and varies between a low value, corresponding to the open position, and a high value, corresponding to the closed position.

During the first subphase P1, the curves 62 and 64 are superposed, indicating that the respective power supply currents of the coil 4 are essentially identical, whether or not the method is applied. The limitation is here not implemented and therefore is not prejudicial to the displacement of the mobile part.

On the other hand, during the second subphase P2, the curve 64 differs from the curve 62, particularly in that the curve 64 is truncated above a threshold value in relation to the curve 62. This reflects the fact that the power supply current of the coil 4 is limited automatically by the circuit 2. The power supplied to the coil 4 by the circuit 2 is thus reduced. Thus, the circuit 2 as described makes it possible to optimize the limitation of the current power supply of the coil 4 in the closure phase.

The embodiments and the variants considered above can be combined with one another to generate novel embodiments.

The invention claimed is:

1. A method for controlling electrical current in a switchgear, said switchgear comprising an electromagnetic actuator provided with a coil for displacing a mobile switching part of the switchgear, said method comprising:

receiving a command to switchover the electrical switchgear from an open state to a closed state;

in response, supplying an electrical power supply current to a coil of the actuator, with a control circuit, to displace the mobile switching part from an open position to a closed position;

wherein the supplying of the power supply current comprises implementing a limitation of a value of an intensity of the electrical power supply current, said limitation comprising steps:

a) acquiring a power supply current limit value by a microcontroller of the control circuit, said value being stored in digital form (Vref_value) in a memory of the control circuit;

b) generating a reference value (Vref_in−) in a form of an analogue signal, representative of the power supply current limit value, from the acquired limit value (Vref_value) and with a digital-analogue converter of the control circuit;

c) acquiring, by the control circuit, a signal (Isense) representative of the intensity of the power supply current circulating through the coil;

d) comparing, with an analogue comparator of the control circuit, the reference analogue signal (Vref_in−) with the signal (Isense) representative of the intensity of the power supply current;

e) inhibiting, by the control circuit, of a pulse width modulation (PWM) signal that controls the current power supply of the coil, in response to the comparing, as long as the intensity (Isense) of the power supply current has a value greater than or equal to the reference value (Vref_in−), the PWM signal that controls the current power supply of the coil being re-established when the intensity (Isense) of the power supply current returns below the reference value.

2. The method according to claim 1, wherein the generating of the reference signal comprises:

reading the limit value (Vref_value) stored in the memory, said reading comprising an emission of a request for direct access to the memory emitted by the converter with a memory controller of the control circuit, then, transforming, by the converter, the acquired limit value (Vref_value) into an analogue signal forming the reference value (Vref_in−).

3. The method according to claim 1, wherein the acquiring of the signal (Isense) representative of the intensity of the power supply current is performed with a measurement probe belonging to the control circuit.

4. The method according to claim 3, wherein the current measurement probe comprises a measurement resistor connected in series with the coil and wherein the acquisition comprises measurement of electrical voltage at terminals of the measurement resistor.

5. The method according to claim 1, wherein the supplying of the power supply current comprises generating an electrical power supply current based on the PWM signal, the PWM signal being generated by a controllable switch of the control circuit.

6. An electromagnetic actuator for electrical current electrical switchgear, comprising a coil and a control circuit adapted to electrically power the coil, the actuator being adapted to selectively displace a mobile switching part of the electrical switchgear under the action of the coil, the control circuit being adapted to:

receive a command to switchover the electrical switchgear from an open state to a closed state;

in response, supply an electrical power supply current to the coil to displace the mobile switching part from an open position to a closed position;

wherein the control circuit is configured for the supply of the power supply current to include implementation of a limitation of a value of an intensity of the electrical power supply current, said limitation comprising steps:

a) acquiring a power supply current limit value by a microcontroller of the control circuit, said value being stored in digital form (Vref_value) in a memory of the control circuit;

b) generating a reference value (Vref_in−) in the form of an analogue signal, representative of the power supply current limit value, from the acquired limit value (Vref_value) and with a digital-analogue converter of the control circuit;

c) acquiring, by the control circuit, a signal (Isense) representative of the intensity of the power supply current circulating through the coil;

d) comparing, with an analogue comparator of the control circuit, the reference analogue signal (Vref_in−) with the signal (Isense) representative of the intensity of the power supply current;

e) inhibiting, by the control circuit, a pulse width modulation (PWM) signal that controls the current power supply of the coil, in response to the comparison, as long as the intensity (Isense) of the power supply current has a value greater than or equal to the reference value (Vref_in−), PWM signal that controls the current power supply of the coil being re-established when the intensity (Isense) of the power supply current returns below the reference value.

7. An electrical current electrical switchgear, comprising a switching block and an electromagnetic actuator, the switching block comprising:

a fixed armature onto which connection terminals are fixed, and a mobile switching part, that can be displaced in relation to the connection terminals, between open and closed positions, to prevent or, respectively, allow the circulation of an electrical current between the connection terminals, the electromagnetic actuator comprising a coil and a control circuit adapted to electrically power the coil, the electrical switchgear comprising the electromagnetic actuator according to claim 6.

* * * * *